US010662673B2

(12) United States Patent
Jian et al.

(10) Patent No.: US 10,662,673 B2
(45) Date of Patent: May 26, 2020

(54) DISPOSABLE ANTI-TAMPERING LOCK CATCH

(71) Applicant: SHANGHAI HONGYAN RETURNABLE TRANSIT PACKAGINGS CO., LTD, Shanghai (CN)

(72) Inventors: Yuanli Jian, Shanghai (CN); Kai Gong, Shanghai (CN); Yiwen Cao, Shanghai (CN)

(73) Assignee: SHANGHAI HONGYAN RETURNABLE TRANSIT PACKAGINGS CO., LTD, Shanghai (CN)

( * ) Notice: Subject to any disclaimer, the term of this patent is extended or adjusted under 35 U.S.C. 154(b) by 324 days.

(21) Appl. No.: 15/548,589

(22) PCT Filed: Jan. 27, 2016

(86) PCT No.: PCT/CN2016/072344
§ 371 (c)(1),
(2) Date: Aug. 3, 2017

(87) PCT Pub. No.: WO2016/124090
PCT Pub. Date: Aug. 11, 2016

(65) Prior Publication Data

US 2018/0002953 A1 Jan. 4, 2018

(30) Foreign Application Priority Data

Feb. 3, 2015 (CN) ..... 2015 1 0056638

(51) Int. Cl.
*E05B 39/02* (2006.01)
*G09F 3/03* (2006.01)
*G09F 3/06* (2006.01)

(52) U.S. Cl.
CPC ..... *E05B 39/02* (2013.01); *G09F 3/0323* (2013.01); *G09F 3/06* (2013.01); *B65D 2101/0007* (2013.01); *Y10T 292/48* (2015.04)

(58) Field of Classification Search
CPC ..... Y10T 292/48; E05B 39/00; E05B 39/02; B65D 2101/00; B65D 2101/0007; G09F 3/03; G09F 3/0323
See application file for complete search history.

(56) References Cited

U.S. PATENT DOCUMENTS 1,615,225 A * 1/1927 Johnson ..... G09F 3/037 292/315
3,656,247 A * 4/1972 Bushnell ..... G09F 3/005 40/633

(Continued)

FOREIGN PATENT DOCUMENTS

CN 2376441 5/2000
CN 101649696 2/2010

(Continued)

OTHER PUBLICATIONS

International Search Report for international application No. PCT/CN2016/072344, dated May 6, 2016 (4 pages, including English translation).

*Primary Examiner* — Carlos Lugo
(74) *Attorney, Agent, or Firm* — Hamre, Schumann, Mueller & Larson, P.C.

(57) ABSTRACT

A disposable anti-tampering lock catch is an integrated piece and comprises a handle, a main tearing portion, a locking portion, a limiting portion and an auxiliary tearing arm. A first tearing structure which cannot be restored after being torn is arranged on the main tearing portion. The auxiliary tearing arm is provided with a second tearing structure, wherein when the disposable anti-tampering lock catch is opened, both the first tearing structure and the second tearing (Continued)

structure are torn, and the shape of the auxiliary tearing arm is deformed after being torn and cannot be reset.

11 Claims, 10 Drawing Sheets

(56) References Cited

U.S. PATENT DOCUMENTS 4,060,922 A * 12/1977 Reggers ..... A01K 11/001 40/302
4,198,772 A * 4/1980 Furutu ..... G09F 3/00 292/318
4,299,417 A * 11/1981 McClure ..... G09F 3/0358 292/320
5,522,627 A * 6/1996 Swift ..... G09F 3/0358 292/307 R
6,343,819 B1 * 2/2002 Shiozaki ..... G09F 3/037 292/307 A
6,409,237 B1 * 6/2002 Olshausen ..... G09F 3/0311 292/307 A
6,511,108 B1 * 1/2003 Roessner, III ..... B65D 55/06 24/16 PB
6,546,652 B1 * 4/2003 Gardner ..... A01K 11/001 119/655
6,869,113 B2 * 3/2005 Burt ..... G09F 3/0352 292/307 A
6,997,489 B2 * 2/2006 De Lima Castro ..... G09F 3/037 292/307 A
7,465,135 B2 * 12/2008 Fritsch ..... F16B 37/043 411/112
7,472,933 B2 * 1/2009 Weedon ..... G09F 3/0358 292/307 A
8,695,244 B2 * 4/2014 Eadie ..... A01K 11/002 119/651

FOREIGN PATENT DOCUMENTS

| | | |
|---|---|---|
| CN | 102797387 | 11/2012 |
| CN | 103696628 | 4/2014 |
| CN | 203570001 | 4/2014 |
| CN | 104727662 | 6/2015 |
| WO | 2013144487 | 10/2013 |

* cited by examiner

DISPOSABLE ANTI-TAMPERING LOCK CATCH

FIELD

The present invention relates to an anti-tampering structure which is disposable and cannot be opened unless damaged, and in particular an environmentally friendly anti-tampering lock catch with tearing piece(s) not scattered after being disposably rigid damaged.

BACKGROUND

At present, there are many kinds of disposable lock catches on the markets, which are mainly used to connect two or more components (products), so as to achieve locking and fastening effects, and so on.

Some of these lock catches have anti-tampering technical effect, such as a toed catch for a lid of box or container disclosed in the utility model CN 99237860, in which the lock catch is snapped in the box and connects the box and the lid together. When operating, it is required to damage the lock catch to open the lid, thus achieving anti-tampering technical effect. However, after the lock catch has been damaged, tearing piece(s) drops into the box, which is not environmentally friendly and not easy for recovering, and a range of applications is limited.

CN 200910042099 discloses another lock catch, which has a structure with a button of a locking beam snapped into a locking body, so as to achieve anti-tampering effect. However, this structure has many components, complex structure, and high mould cost. Further, when opening, it is required to damage the disposable lock catch with the aid of a dedicated tool, where the operation is not convenient.

SUMMARY

The objective of the present invention is to provide a rigid and environmentally anti-tampering lock catch which can be opened without a special tool, and the tearing material is not chopped off after being torn. It will not produce elastic deformation upon force and easy to operate. The disposable anti-tampering lock catch has a simple structure, which is easy to disassemble and assemble.

In order to achieve the above objective, the present invention provides a disposable anti-tampering lock catch, wherein the disposable anti-tampering lock catch is one-piece and comprises:

a handle;

a main tearing portion provided with a first tearing structure which cannot be restored after tearing, a locking structure capable of being inserted into a locking hole of a locked object so that the disposable anti-tampering lock catch is in a locked state, and a position limiting structure for controlling the locking structure to be in a locked state or an unlocked state; and an auxiliary tearing arm having a second tearing structure, wherein the first tearing structure and the second tearing structure are torn when the disposable anti-tampering lock catch is opened, and the auxiliary tearing arm is deformed and cannot be restored after tearing.

Preferably, the first tearing structure is a tearing rid.

Preferably, the auxiliary tearing arm is elastically deformed after the second tearing structure has been torn.

Preferably, the second tearing structure is a tearing rib provided at one end of the auxiliary tearing arm, and the other end of the auxiliary tearing arm is connected to other part of the disposable anti-tampering lock catch by a resilient structure.

In one embodiment, the disposable anti-tampering lock catch is provided with a main tearing hook cooperating with the first tearing structure and an auxiliary tearing hook cooperating with the second tearing structure, and in the locked state, the main tearing hook and the auxiliary tearing hook hang on the first tearing structure and the second tearing structure respectively, and when opening the disposable anti-tampering lock catch, the main tearing hook and the auxiliary tearing hook apply forces to the first tearing structure and the second tearing structure, respectively, so as to tear the first tearing structure and the second tearing structure.

In one embodiment, the locking structure is a rigid locking structure capable of being inserted and movable in the lock hole of the locked object, so as to be switched between a state in which the rigid locking structure is capable of being detached from the lock hole and a state in which the rigid locking structure is not capable of being disengaged from the lock hole;

the position limiting structure is configured for cooperating with a locked object position limiting hole on the locked object to control the rigid locking structure to be in a locked state or a movable state; wherein when the rigid locking structure is in the state in which the rigid locking structure is not capable of being disengaged from the lock hole, the position limiting structure is inserted into the locked object position limiting hole and the rigid locking structure is in a locked state so that the anti-tampering lock catch is tightly locked;

when opening the disposable anti-tampering lock catch, the first tearing structure and the second tearing structure are both torn, the position limiting structure is separated from the locked object position limiting hole of the locked object, and the rigid locking structure is in a state in which the rigid locking structure is capable of being disengaged from the lock hole and movable so that the anti-tampering lock catch is detached from the locked object.

In the above embodiment, the anti-tampering lock catch further comprises a foldable portion, the locking structure is provided on a locking portion, the position limiting structure is provided on a position limiting portion, and the handle and the position limiting portion are connected to the locking portion and the main tearing portion through the foldable portion, so that the handle and the position limiting portion are rotatable with respect to the locking portion and the main tearing portion; the handle is provided with a first structure cooperating with the first tearing structure to tear the first tearing structure when opening the lock catch, and the locking portion is provided with a second structure cooperating with the second tearing structure to tear the second tearing structure when opening the lock catch; and the main tearing portion is further provided with a pin position limiting hole, and the position limiting structure on the portion limiting portion is a position limiting pin for cooperating with the pin position limiting hole and the locked object position limiting hole on the locked object, so as to control the rigid locking structure to be in a locked state or a movable state; wherein when the rigid locking structure is in the state in which the rigid locking structure is not capable of being disengaged from the lock hole, the position limiting pin is inserted into the pin position limiting hole and the rigid locking structure is in the locked state, thereby the anti-tampering lock catch is tightly locked; when opening the disposable anti-tampering lock catch, the first tearing structure and the second tearing structure are both torn, the position limiting pin is separated from the pin position limiting hole and the locked object position limiting hole on the locked object, and the rigid locking structure is in the state in which the rigid locking structure is capable of being disengaged from the lock hole and movable so that the anti-tampering lock catch is detached from the locked object.

Preferably, the anti-tamper lock catch is made of high strength plastic material.

Preferably, the first structure and the second structure is clasp.

Preferably, the second structure is provided on a side opposite to the rigid locking structure.

Preferably, the locking portion has a plate-like body, and the rigid locking structure is a pillar extending from the plate-like body, and a protrusion is provided on the outer periphery of the pillar, and the distance of the protrusion from the plate-like body is greater than the thickness of the object to be locked at the locking place.

Preferably, the handle is a plate-like body, and one end of which is provided with a skid resistance chute or a skid resistance strip on one side and security code on the other side.

In one embodiment, the position limiting portion is a plate-like body, and the position limiting pin is a pin protruding from the plate-like body; and the tearing portion has a plate-like body, and the first tearing structure is located on both sides of the plate-like body, and the pin position limiting hole is in the middle of the plate-like body, and a through groove is provided between the first tearing structure and the pin position limiting hole so that a hook can be inserted into the through groove to be snap-fit with the first tearing structure, so as to tear the first tearing structure when opening.

Preferably, tensile strengths of the first tearing structure and the second tearing structure are less than those of the foldable portion and the handle.

Preferably, the distance from the pin position limiting hole to the folded portion is set so that the position limiting pin can be inserted into the pin position limiting hole when the position limiting portion is rotated and folded around the foldable portion, and at the same time, the distance between the groove and the foldable portion is set so that the clasp can be snapped in the groove and can be moved left and right along the groove when the position limiting portion is rotated and folded around the foldable portion.

Preferably, the main tearing portion and the auxiliary tearing arm are not detached from the disposable anti-tampering lock catch after having been torn, and the locking structure is rigid when in a locked state.

In another embodiment, the locking structure is provided with locking members and a position limiting hole, and the position limiting structure is provided with a fixing plate, when being locked, the locking members are snapped in the lock hole of the locked object and the fixing plate is inserted into the position limiting hole so as to limit the locking members so that the locking members can not be detached from the lock hole.

Preferably, the handle is provided with a clasp, and the first tearing structure is a plurality of tearing ribs, and the clasp cooperates with the plurality of tearing ribs after assembly; and one end of the auxiliary tearing arm is connected to the handle through the second tearing structure and the other end is connected to the main tearing portion, and after the second tearing structure has been torn, the auxiliary tearing arm rebounds.

The disposable anti-tampering lock catch of the present invention has a simple structure, which is easy to disassemble and manufacture and has low cost. In addition, due to the use of high-strength rigid snap-fit structure, it will not produce elastic deformation when applying force, thus ensuring the lock catch will not accidentally be damaged or dropped during the transport process of goods. In addition, since the auxiliary tearing arm is provided, once the disposable anti-tampering lock catch is opened, the auxiliary tearing arm is deformed, such as bending upward, such that it can be clearly seen from the appearance that the lock catch has been opened.

DETAILED DESCRIPTION OF EMBODIMENTS

Figure 1:
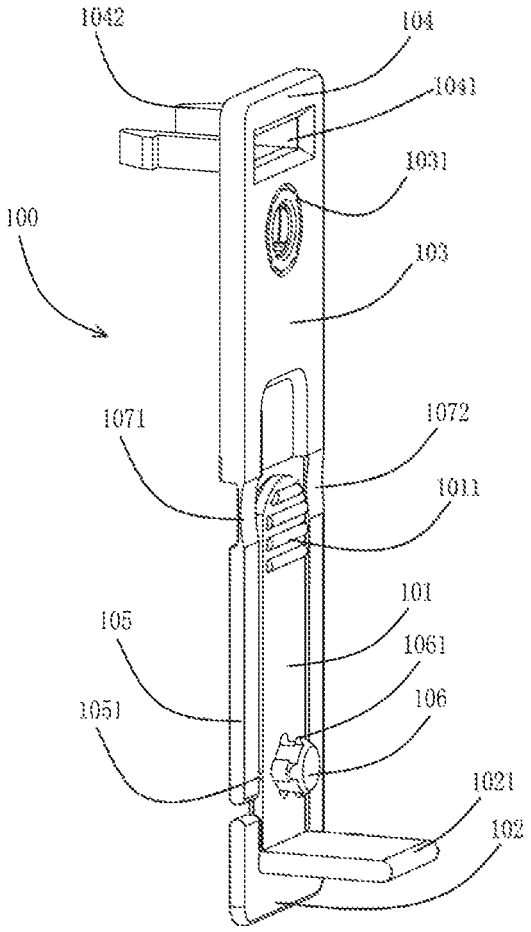
FIG. 1 shows a perspective view of a disposable anti-tampering lock catch according to a first embodiment of the present application.

Hereinafter, preferred embodiments of the present invention will be described in detail with reference to the drawings, so that the purposes, features and advantages of the present invention will be more clearly understood. It should be understood that embodiments shown in the drawings are not to limit the scope of the present invention, but merely to illustrate the true spirit of the technical solution of the present invention.

Figure 2:
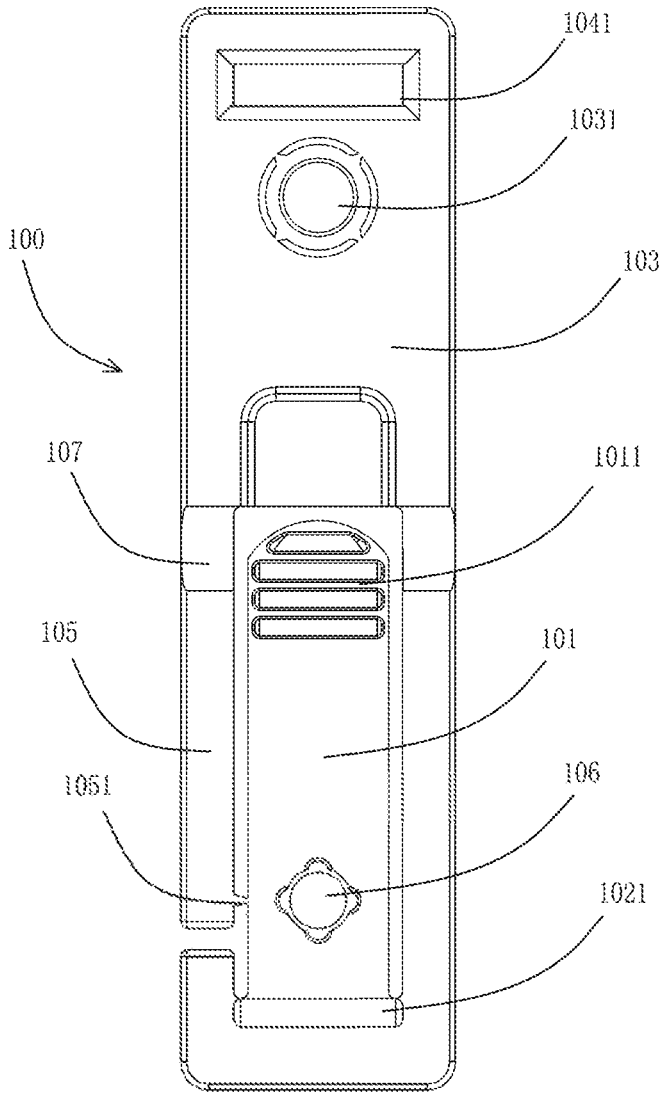
FIG. 2 shows a front view of the disposable anti tampering lock catch of FIG. 1.
Figure 3:
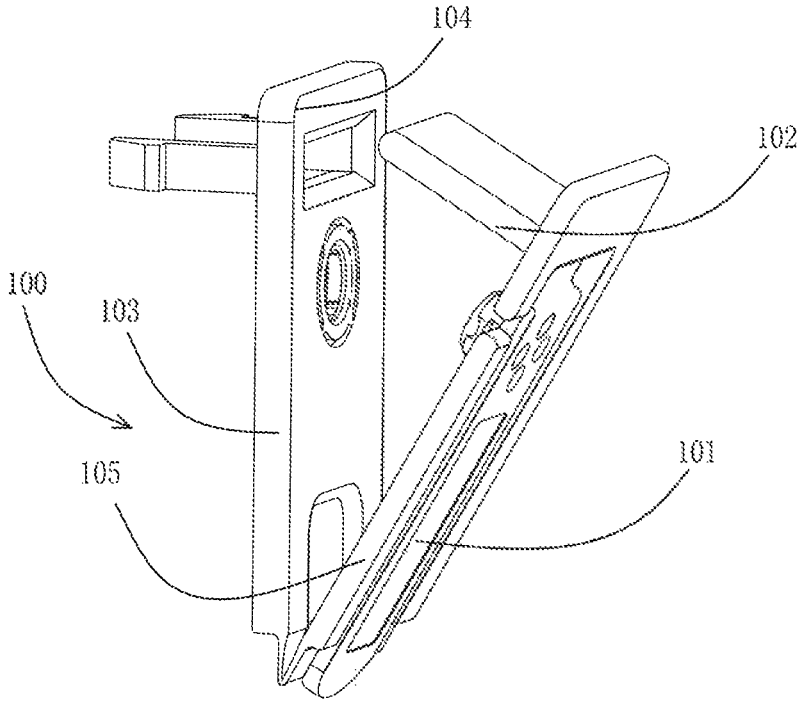
FIGS. 3 and 4 show perspective views of a process for locking the disposable anti-tampering lock catch of FIG. 1.
Figure 4:
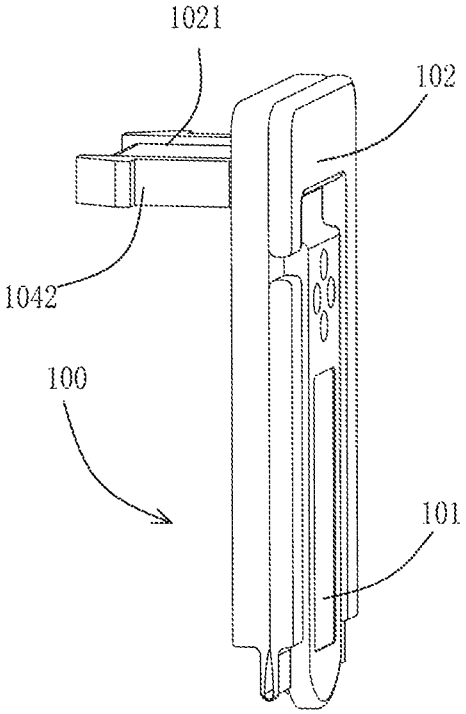
Figure 5:
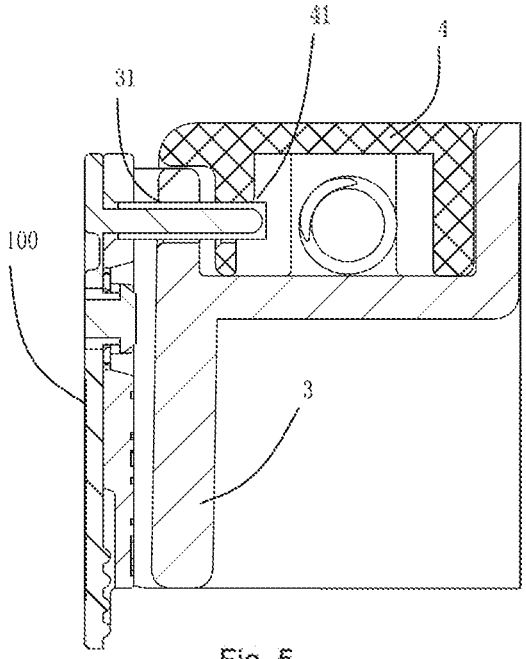
FIG. 5 shows a sectional view of the disposable anti-tampering lock catch of FIG. 1 locked on the object to be locked.
Figure 6:
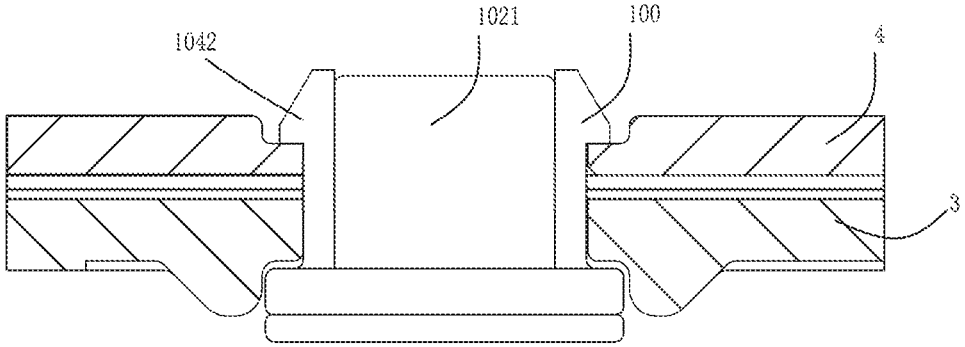
FIG. 6 shows another sectional view of the disposable anti-tampering lock catch of FIG. 1 locked on the object to be locked.

FIGS. 1 and 2 illustrate a perspective structure view and a front view of a disposable anti-tampering lock catch according to a first embodiment of the present invention. As shown in FIGS. 1-2, the disposable anti-tampering lock catch 100 includes a handle 101, a position limiting portion 102, a main tearing portion 103, a locking portion 104, and an auxiliary tearing arm 105, wherein the locking portion 104 is provided with a locking structure 1042, which is able to be inserted into a lock hole (not shown) of object to be locked such that the disposable anti-tampering lock catch is in the locking state. The position limiting portion is provided with a position limiting structure 1021, which can be inserted into a position limiting hole 1041 of the locking portion so as to control the locking structure 1042 being in the locking state or in the unlocking state. The main tearing portion 103 is provided with a first tearing structure 1031 which cannot be restored after being torn. The auxiliary tearing arm 105 is provided with a second tearing structure 1051 connected to the handle 101. When opening the disposable anti-tampering lock catch 100, the first tearing structure 1031 and the second tearing structure 1051 are both torn, and the auxiliary tearing arm 105 is deformed and cannot be restored after having been torn.

The locking portion 104 is provided at one end of the anti-tampering lock catch 100. The locking portion 104 is provided with two locking members 1042 and one position limiting hole 1041, and the locking members 1042 can be snapped into a lock hole (not shown) of object to be locked. The position limiting portion 102 is provided at the other end of the anti-tampering lock catch 100. The position limiting portion 102 is provided with a position limiting plate 1021. A foldable portion 107 is provided in the middle of the anti-tampering lock catch 100. When locking, the position limiting portion 102 is rotated 180 degrees about the foldable portion, and the position limiting plate 1021 is inserted into the position limiting hole 1041 to limit positions of the locking members 1042, so that the locking members 1042 cannot be detached from the lock hole of the object to be locked. When unlocking, the position limiting plate is taken away from the position limiting hole, and position limiting for the locking members 1042 is removed, so that the unlocking can be achieved.

The handle 101 is a plate-like body, one end of which is provided with a skid resistance chute or a skid resistance bar 1011 on one face and a security code on the other face. The other end of the handle 101 is connected to the position limiting portion 102. A protrusion 106 for tearing the first tearing structure 1031 is provided between the skid resistance bar 1011 of the handle 101 and the position limiting plate 1021 of the position limiting portion 102. The protrusion 106 is provided with a hook 1061. When assembled, the hook(s) is snapped in the first tearing structure 101.

One end of the auxiliary tearing arm 105 is connected to the handle 101 through a rib 1051 (a second tearing structure) and the other end is connected to the main tearing portion by an elastic structure 1071, so that after the rib 1051 has been torn, the auxiliary tearing arm 105 is elastically deformed (rebound). And because the rib of the auxiliary tearing arm cannot be restored at this time, the elastic deformation of the auxiliary tearing arm cannot be restored. Therefore, when the auxiliary tearing arm has been torn, its elastic deformation can be remarkably observed in appearance.

The position limiting portion 102 is connected to the main tearing portion 103 through another elastic structure 1072. The elastic structure 1071 and the elastic structure 1072 together form the foldable portion so that the handle 101, the position limiting portion 102, and the auxiliary tearing arm 105 can be folded through rotating around the foldable portion together.

In the present embodiment, the first tearing structure 1031 provided on the main tearing portion 103 is composed of a plurality of tearing bars or tearing ribs. The hook(s) 1061 on the protrusion 106 can snap into the first tearing structure 103 when the handle 101, the position limiting portion 102, and the auxiliary tearing arm 105 are folded through rotating around the foldable portion together.

Before use, the disposable anti-tampering lock catch 100 is flattened as shown in FIGS. 1 and 2. As shown in FIGS. 3-6, when locking, lock holes 31 and 41 are provided on the objects to be locked 3 and 4, respectively. The locking members 1042 are inserted into the lock holes 31 and 41 in turn, and then the position limiting portion 102 is rotated 180 degrees around the foldable portion so that the position limiting plate 1021 is inserted into the position limiting hole 1041 while the hook(s) 1061 on the protrusion 106 snaps into the first tearing structure 1031, which makes it impossible for the position limiting portion 102 to spring back so that the disposable anti-tampering lock catch cannot be pulled out from the lock holes of the object to be locked.

Figure 7:
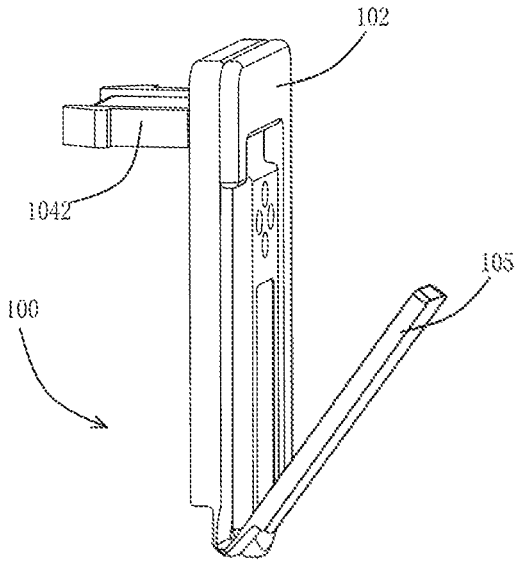
FIGS. 7 and 8 show a process for unlocking the disposable anti-tampering lock catch of FIG. 1.
Figure 8:
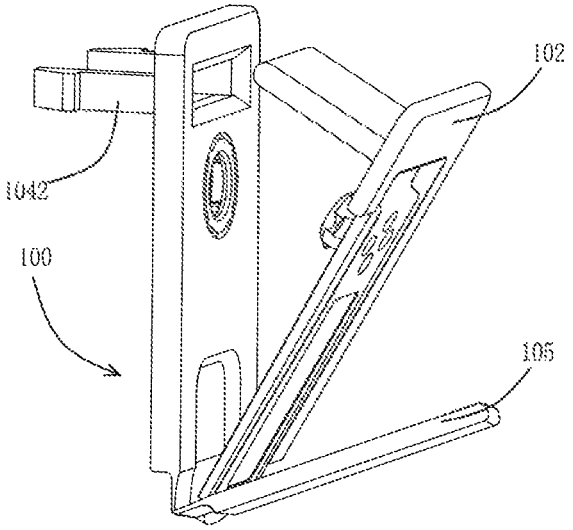

When unlocking, as shown in FIGS. 7-8, the handle 101 is pulled to pull apart the first tearing structure 1031 so as to allow the position limiting plate 1021 to be disengaged from the locking members 1042 to enable opening. The rib 1051 on the auxiliary tearing arm 105 is simultaneously pulled apart (torn) during a process that the first tearing structure is pulled apart, and the auxiliary tearing arm 105 bends by the rebound effect when the rib 1051 has been torn, so as to imply the lock catch has been opened. After tearing, the first tearing structure 1031 and the auxiliary tearing arm are not detached from the anti-tampering lock catch.

Figure 9:
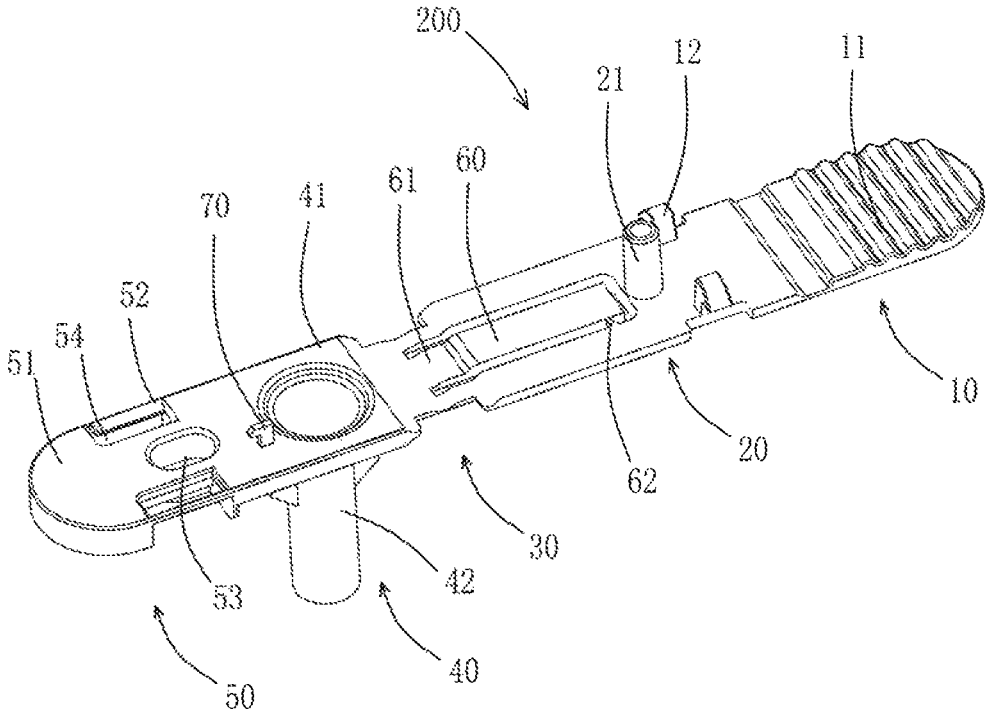
FIG. 9 shows a perspective view of a disposable anti-tampering lock catch according to a second embodiment of the present invention.
Figure 10:
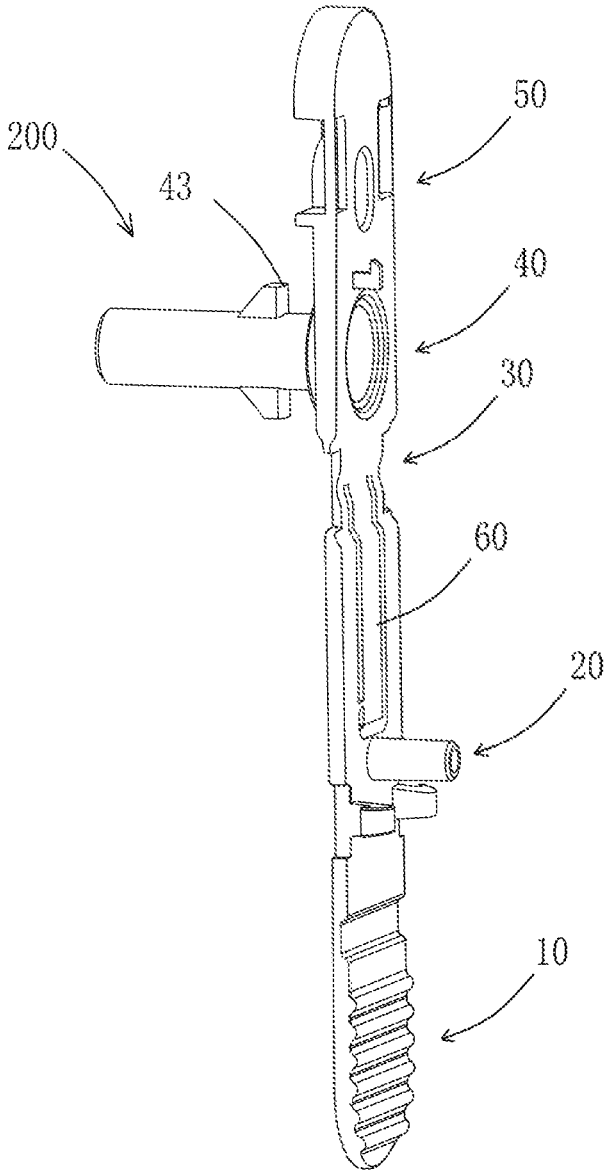
FIG. 10 shows another perspective view of the disposable anti-tampering lock catch of FIG. 9.
Figure 11:
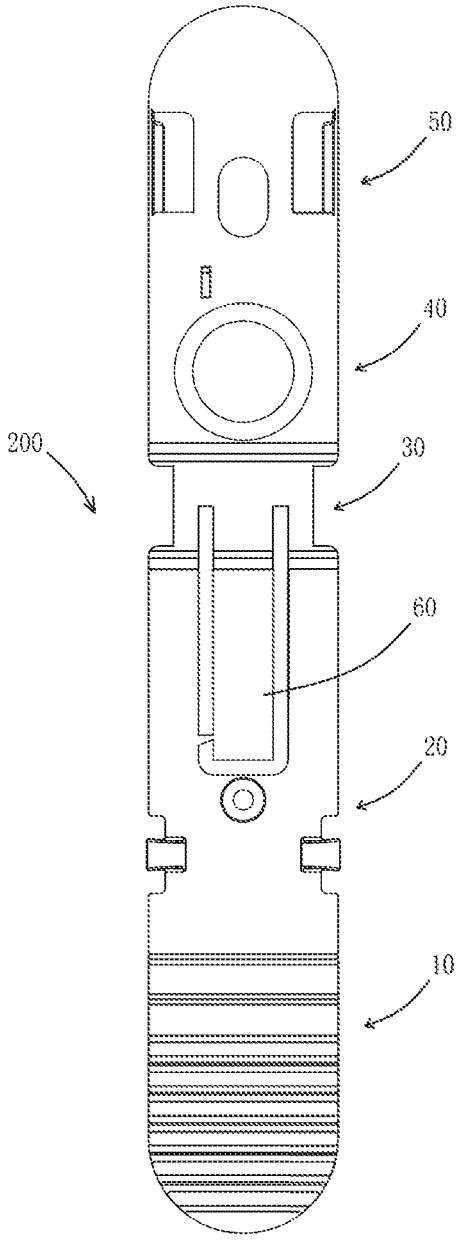
FIG. 11 shows a front view of the disposable anti-tampering lock catch of FIG. 9.

FIGS. 9-11 illustrate a structure view of the disposable anti-tampering lock catch 200 according to a second embodiment of the present invention. As shown in FIGS. 9-11, the disposable anti-tampering lock catch 200 includes a handle 10, a position limiting portion 20, a foldable portion 30, a locking portion 40, a main tearing portion 50, and an auxiliary tearing arm 60. The handle 10 and the position limiting portion 20 are connected to the locking portion 40 and the main tearing portion 50 through the foldable portion 30. One end of the auxiliary tearing arm 60 is connected to the position limiting portion 20 by a tearing rib 62 and the other end is connected to the foldable portion 30 through an elastic structure 61. Preferably, the handle 10, the position limiting portion 20, the foldable portion 30, the locking portion 40, the main tearing portion 50, and the auxiliary tearing arm 60 are formed as one piece. Preferably, the integral rigid anti-tampering lock catch is injection molded from high strength plastic material.

In the disposable anti-tampering lock catch 200 of the present embodiment, the handle 10 is provided with a clasp 12, and the position limiting portion 20 is provided with a position limiting pin 21. The locking portion 40 is provided with a crook 70 and a rigid locking structure 42, and in the present embodiment, the rigid locking structure is a rigid snap-fit structure 42. The main tearing portion 50 is provided with a tearing bar 52 and a pin position limiting hole 53 for engaging with the position limiting pin 21 to prevent the lock catch from moving. When locking, the rigid snap-fit structure 42 of the anti-tampering lock catch 200 is snapped into a lock hole 41 on the object to be locked (see FIG. 5). The handle 10 and the position limiting portion 20 can be rotated about the foldable portion 30 so that the position limiting pin 21 is inserted into the pin position limiting hole 53 on the main tearing portion 50 and a looked object position limiting bole on the object to be looked while the clasp(s) 12 on the handle 10 is snap-fit with the tearing bar(s) 52 and the crook 70 on the locking portion 40 is snap-fit with the rib 62 thereby completing the locking of the object to be locked. When the unlocking is required, the handle 10 is pulled which further pulls the clasp(s) 12 and the crook 70, and then the clasp(s) 12 and the crook. 70 tear the tearing bar(s) 52 and the rib 62 respectively. At this time, the anti-tampering lock catch 200 can be removed from the object to be locked and the locked object is unlocked. After the rib 62 has been torn, the auxiliary tearing arm rebounds and bends, so as to imply the lock catch has been opened.

The handle 10 is a main operating portion for mounting and opening. The handle 10 is a plate-like body with a skid resistance chute or a skid resistance bar 11 provided on one face thereof for easy hand-held operation. On the other face, a security code (not shown) may be provided, for example by spraying, so as to achieve anti-tampering effect, which will be described in more detail below. On both sides of the handle 20 near the position limiting portion, a clasp 12 is provided as a barbed structure. The clasp 12 is used to engage with the main tearing portion so as to tear off the tearing bar on the main tearing portion when the lock catch is unlocked, as will be described in more detail below. The shape of the clasp 12 is not limited to a hook, but may have any suitable shape as long as it can snap into the main tearing portion when locking and be able to tear off the tearing bar when unlocking.

The position limiting portion controls the movement of the lock catch, so as to make the locking portion in a locked state or a movable state. The position limiting portion 20 is a plate-like body, and the position limiting pin 21 provided on the position limiting portion 20 is a cylindrical pin. However, it should be noted that the position limiting pin 21 may also be a pin whose lateral section is a suitable shape, such as a square shape, an oval shape, or the like.

The locking portion 40 has a plate-like body 41 provided with a rigid snap-fit structure 42 extending therefrom, and the rigid snap-fit structure 42 is used to lock a single piece or a plurality of pieces of object to be locked. In the embodiment shown in FIG. 1, the rigid snap-fit structure 42 is a pillar, and the outer periphery of the pillar is provided with a projection 43. The distance of the projection 43 from the plate-like body 41 is slightly greater than the thickness of the object to be locked at the locking position.

The main tearing portion 50 has a plate-like body 51, the tearing bars 52 are provided on both sides of the body 51, the pin position limiting hole 53 is provided in the middle of the plate-like body 51, and a groove 54 is provided between the tearing bar 52 and the pin position limiting hole 53 so that the clasp(s) 12 can be inserted into the groove(s) 54 respectively and snap-fit with the tearing bar(s) 52. The tensile strength of the tearing bar must be smaller than the tensile strength of the foldable portion or the handle body, keeping the foldable portion 30 not damaged when the main tearing portion 50 is torn.

The distance from the pin position limiting hole 53 to the foldable portion 30 is set so that the position limiting pin 21 can be inserted into the pin position limiting hole 53 when the position limiting portion 20 is rotated and folded around the foldable portion 30. At the same time, the distance between the groove 54 and the foldable portion 30 is set so that the clasp 12 can be snapped in the groove 54 and can be moved left and right along the groove 54 when the position limiting portion 20 is rotated and folded around the foldable portion 30.

Figure 12:
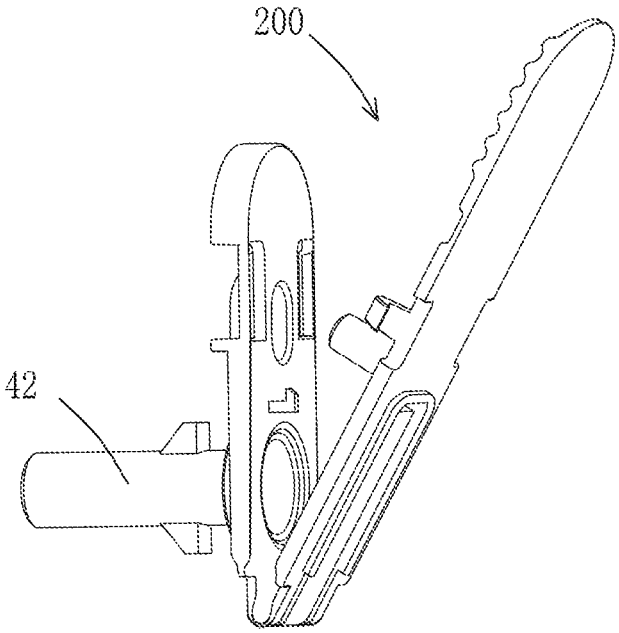
FIGS. 12 and 13 show perspective views of a process for locking the disposable anti-tampering lock catch of FIG. 9.
Figure 13:
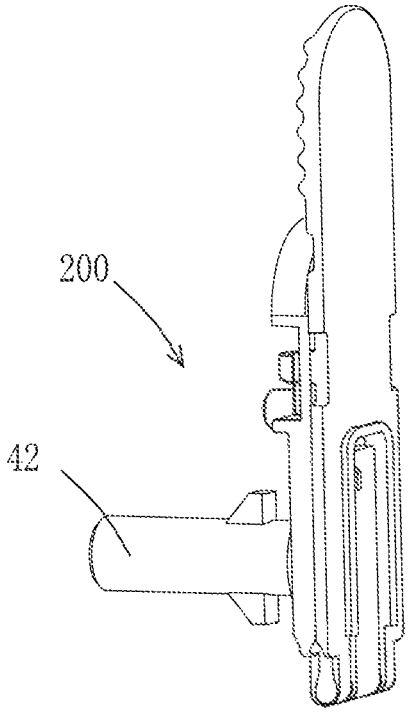

FIGS. 12-13 illustrate a schematic view of the locking process for the disposable anti-tampering lock catch of FIGS. 9-11. As shown in FIGS. 12-13, during the locking process, the rigid snap-fit structure is first inserted into the lock hole of the object to be locked (not shown). When the projection 43 of the rigid snap-fit structure 42 exceeds the inside of the object to be locked, the anti-tampering lock catch 200 is rotated by an angle so that the rigid snap-fit structure 42 cannot be disengaged from the lock hole on the object to be locked and the object to be locked is locked tightly, and at this time, position of the lock catch is not limited. Next, the foldable portion 30 of the lock catch is folded, the position limiting pin 21 on the position limiting portion 20 is passed through the pin position limiting hole 53 on the main tearing portion while the clasp 12 on the handle 10 is snapped in the main tearing portion, and the position of the lock catch is limited and the lock catch is locked tightly.

Figure 14:
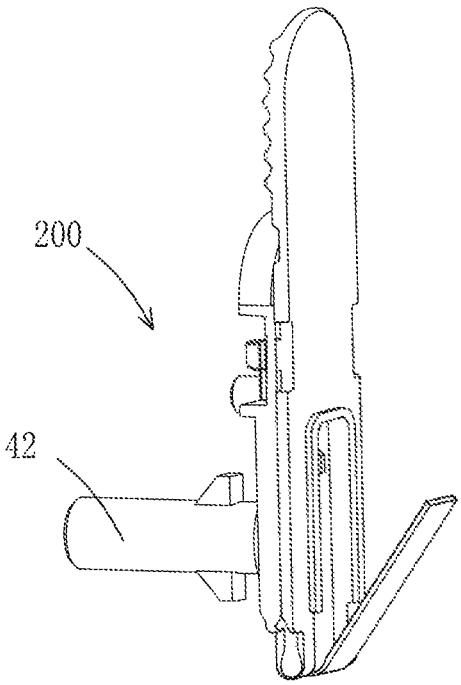
FIGS. 14 and 15 show a process for unlocking the disposable anti-tampering lock catch of FIG. 9.
Figure 15:
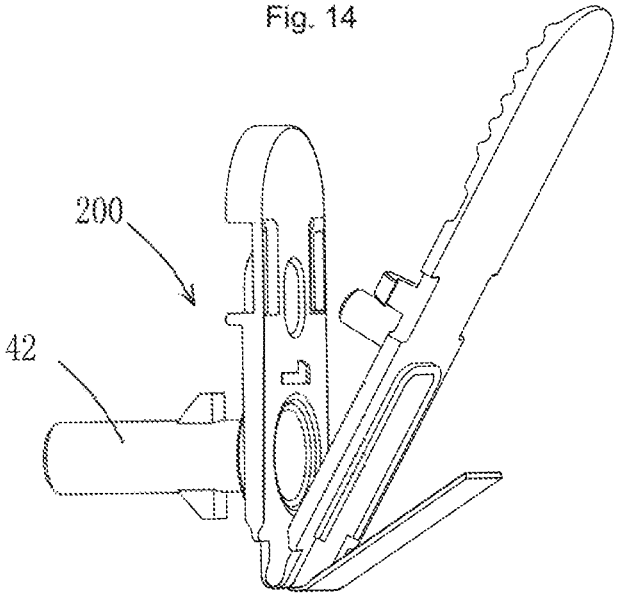

As shown in FIGS. 14-15, during the process of unlocking the lock catch, the handle 10 is pulled, and under the tension action of the clasp 12 on the handle 10 and the crook 70 on the locking portion 40, the tearing bars 53 of the main tearing portion 50 and the rib 62 of the auxiliary tearing arm 60 are pulled apart and torn, so that the handle 10 is pulled up, the position limiting pin 21 on the position limiting portion 20 is disengaged from the locked object position limiting hole and the pin position limiting hole 40 and then the lock catch 200 can be moved. The lock catch 200 is moved to a position where the rigid snap-fit structure 42 can be detached from the lock hole on the object to be locked, and the lock catch 200 is pulled out, to complete unlocking.

In the disposable anti-tampering lock catch of the present invention, after the tearing bar on the main tearing portion has been torn off, the main tearing portion is still connected to the other portion, thereby facilitating recovery.

The disposable anti-tampering lock catch of the present invention has a wide range of applications. The disposable anti-tampering lock catch can be installed, as long as the product to be locked (object to be locked) is perforated to engage with the lock catch. When opening, the main tearing portion of the lock catch must be damaged and cannot be recovered after having been torn. Therefore, if a user finally finds that the lock catch is damaged or the security code on the lock catch is inconsistent with the original setting, the locked object may have been opened, and the user can therefore refuse or further examine in detail, so that the anti-theft effect is good. Further, after the tearing bar on the main tearing portion has been torn off, the main tearing portion is still connected to the other portion which is easy for recycling and has a good environmental effect. In addition, the disposable anti-tampering lock catch of the present invention has a simple structure which is easy to disassemble and manufacture and has a low cost. In addition, since the auxiliary tearing arm is provided and the auxiliary tearing arm is deformed after having been torn and cannot be restored, as long as the disposable anti-tampering lock catch has been opened, it can be clearly seen from the appearance. In other words, by providing the auxiliary tearing arm, it is possible to prevent the issue that when only the main tearing portion is provided, the hook is hung on the tearing bar again after tearing such that it is not apparent from the appearance that the anti-tampering lock catch has been opened.

In addition, due to the use of high-strength rigid snap-fit structure, it will not produce elastic deformation under force, thus ensuring the lock catch will not accidentally be damaged or dropped during the transport process of goods.

It should be noted that the structure of the lock hole on the object to be locked can be set to be a different structure as required, and accordingly, the specific structure of the rigid snap-fit structure may also be set as desired, as long as during the process of being locked and/or unlocked, the rigid snap-fit structure can be inserted into the lock hole and may not disengage from the lock hole after moving (translation or rotation) in the lock hole for a certain distance (or angle).

Preferred embodiments of the present invention has been described in detail above, while it is to be understood that, after reading the above teachings of the present invention, those skilled in the art may make various modifications or amendments to the present invention. These equivalent forms still fall into the scope limited by appended claims of the present application.

What is claimed is:

1. A disposable anti-tampering lock catch, wherein the disposable anti-tampering lock catch is one-piece and comprises:

a handle provided with a protrusion having at least one hook, and a position limiting structure extending away from the handle;

a main tearing portion provided with a locking structure and provided with a folding portion between the main tearing portion and the handle which pivotably connects the handle to the main tearing portion, the main tearing portion is further provided with a keeper member provided with a first tearing structure which cannot be restored after tearing; and an auxiliary tearing arm attached to the handle and provided with a second tearing structure which cannot be restored after tearing, wherein, the locking structure is capable of being inserted into a locking hole of a locked object and the handle is folded over the main tearing portion, the position limiting structure cooperates with the locking structure, and the hook is received in the keeper member so that the disposable anti-tampering lock catch is in a locked state; and wherein in order to open the disposable anti-tampering lock catch, the handle is pivotally pulled, so that the at least one hook will press against the keeper element, tearing the first tearing structure, allowing the position limiting structure to move away from the locking structure and at the same time, the handle movement will tear the second tearing structure allowing the auxiliary tearing arm to be separated from the handle, providing a sign that the disposable anti-tampering lock catch was tempered.

2. The disposable anti-tampering lock catch of claim 1, wherein the auxiliary tearing arm is elastically deformed after the second tearing structure has been torn.

3. The disposable anti-tampering lock catch of claim 1, wherein the second tearing structure is a tearing rib provided at one end of the auxiliary tearing arm, and the other end of the auxiliary tearing arm is connected to other part of the disposable anti-tampering lock catch by a resilient structure.

4. The disposable anti-tampering lock catch of claim 1, wherein the disposable anti-tampering lock catch is provided with a main tearing hook cooperating with the first tearing structure and an auxiliary tearing hook cooperating with the second tearing structure, and in the locked state, the main tearing hook and the auxiliary tearing hook hang on the first tearing structure and the second tearing structure respectively, and when opening the disposable anti-tampering lock catch, the main tearing hook and the auxiliary tearing hook apply forces to the first tearing structure and the second tearing structure, respectively, so as to tear the first tearing structure and the second tearing structure.

5. The disposable anti-tampering lock catch of claim 1, wherein the locking structure is a rigid locking structure capable of being inserted and movable in the lock hole of the locked object, so as to be switched between a state in which the rigid locking structure is capable of being detached from the lock hole and a state in which the rigid locking structure is not capable of being disengaged from the lock hole;

the position limiting structure is configured for cooperating with a locked object position limiting hole on the locked object to control the rigid locking structure to be in a locked state or a movable state; wherein when the rigid locking structure is in the state in which the rigid locking structure is not capable of being disengaged from the lock hole, the position limiting structure is inserted into the locked object position limiting hole and the rigid locking structure is in a locked state so that the anti-tampering lock catch is tightly locked;

when opening the disposable anti-tampering lock catch, the first tearing structure and the second tearing structure are both torn, the position limiting structure is separated from the locked object position limiting hole of the locked object, and the rigid locking structure is in a state in which the rigid locking structure is capable of being disengaged from the lock hole and movable so that the anti-tampering lock catch is detached from the locked object.

6. The disposable anti-tampering lock catch of claim 5, wherein the anti-tampering lock catch further comprises a foldable portion, the locking structure is provided on a locking portion, the position limiting structure is provided on a position limiting portion, and the handle and the position limiting portion are connected to the locking portion and the main tearing portion through the foldable portion, so that the handle and the position limiting portion are rotatable with respect to the locking portion and the main tearing portion;

the handle is provided with a first structure cooperating with the first tearing structure to tear the first tearing structure when opening the lock catch, and the locking portion is provided with a second structure cooperating with the second tearing structure to tear the second tearing structure when opening the lock catch; and the main tearing portion is further provided with a pin position limiting hole, and the position limiting structure on the portion limiting portion is a position limiting pin for cooperating with the pin position limiting hole and the locked object position limiting hole on the locked object, so as to control the rigid locking structure to be in a locked state or a movable state; wherein when the rigid locking structure is in the state in which the rigid locking structure is not capable of being disengaged from the lock hole, the position limiting pin is inserted into the pin position limiting hole and the rigid locking structure is in the locked state, thereby the anti-tampering lock catch is tightly locked;

when opening the disposable anti-tampering lock catch, the first tearing structure and the second tearing structure are both torn, the position limiting pin is separated from the pin position limiting hole and the locked object position limiting hole on the locked object, and the rigid locking structure is in the state in which the rigid locking structure is capable of being disengaged from the lock hole and movable so that the anti-tampering lock catch is detached from the locked object.

7. The disposable anti-tampering lock catch of claim 6, wherein the position limiting portion is a plate shaped body, and the position limiting pin is a pin protruding from the plate shaped body; and the tearing portion has a plate shaped body, and the first tearing structure is located on both sides of the plate shaped body, and the pin position limiting hole is in the middle of the plate shaped body, and a through groove is provided between the first tearing structure and the pin position limiting hole so that a hook can be inserted into the through groove to be snap-fit with the first tearing structure, so as to tear the first tearing structure when opening.

8. The disposable anti-tampering lock catch of claim 7, wherein tensile strengths of the first tearing structure and the second tearing structure are less than those of the foldable portion and the handle.

9. The disposable anti-tampering lock catch of claim 1, wherein the main tearing portion and the auxiliary tearing arm are not detached from the disposable anti-tampering lock catch after having been torn, and the locking structure is rigid when in a locked state.

10. The disposable anti-tampering lock catch of claim 1, wherein the locking structure is provided with locking members and a position limiting hole, and the position limiting structure is provided with a fixing plate, when being locked, the locking members are snapped in the lock hole of the locked object and the fixing plate is inserted into the position limiting hole so as to limit the locking members so that the locking members cannot be detached from the lock hole.

11. The disposable anti-tampering lock catch of claim 10, wherein the handle is provided with a clasp, and the first tearing structure is a plurality of tearing ribs, and the clasp cooperates with the plurality of tearing ribs after assembly; and one end of the auxiliary tearing arm is connected to the handle through the second tearing structure and the other end is connected to the main tearing portion, and after the second tearing structure has been torn, the auxiliary tearing arm rebounds.

* * * * *